US007048640B2

(12) United States Patent
Light

(10) Patent No.: US 7,048,640 B2
(45) Date of Patent: May 23, 2006

(54) GOLF CLUB WEIGHT TRAINING DEVICE

(76) Inventor: Albert James Light, 701 Forest View Ct., Winter Springs, FL (US) 32708

( * ) Notice: Subject to any disclaimer, the term of this patent is extended or adjusted under 35 U.S.C. 154(b) by 0 days.

(21) Appl. No.: 10/835,234

(22) Filed: Apr. 29, 2004

(65) Prior Publication Data

US 2005/0245324 A1 Nov. 3, 2005

(51) Int. Cl.
*A63B 69/36* (2006.01)

(52) U.S. Cl. ..... 473/256; 473/226

(58) Field of Classification Search ..... 473/219, 473/231, 220–226, 437, 256; 482/109; 273/DIG. 30
See application file for complete search history.

(56) References Cited

U.S. PATENT DOCUMENTS

| | | | | |
|---|---|---|---|---|
| 2,608,409 | A * | 8/1952 | Pinkerton | 473/256 |
| 3,490,768 | A | 1/1970 | Archer | |
| 3,680,870 | A | 8/1972 | Burnett et al. | |
| 3,716,239 | A | 2/1973 | Goudreau | |
| 3,740,053 | A | 6/1973 | Eiger | |
| 4,273,130 | A | 6/1981 | Simpson | |
| 4,502,688 | A | 3/1985 | Papp | |
| 4,588,191 | A | 5/1986 | Stewart | |
| 5,178,394 | A | 1/1993 | Tanampai | |
| 5,460,378 | A | 10/1995 | Getts | |
| 5,527,039 | A | 6/1996 | Levesque | |
| 5,776,006 | A | 7/1998 | Gruber | |
| 5,964,671 | A | 10/1999 | Edwards et al. | |
| 5,992,939 | A * | 11/1999 | Gass et al. | 297/463.1 |
| 5,993,325 | A | 11/1999 | Heyer | |
| 6,083,116 | A | 7/2000 | Loredo | |
| 6,120,385 | A | 9/2000 | Nemeckay | |
| 6,599,201 | B1 | 7/2003 | Grant | |
| 6,652,387 | B1 | 11/2003 | Liberatore | |
| 2004/0049967 | A1 * | 3/2004 | DeSorcy | 43/25 |

* cited by examiner

*Primary Examiner*—Nini F. Legesse
(74) *Attorney, Agent, or Firm*—Beusse Wolter Sanks Mora & Maire, P.A.; James H. Beusse

(57) ABSTRACT

A weighting device for removably attaching to a golf club. The device has a mass with a bore formed therethrough and an access slot in open communication with the bore. The slot provides an entrance opening in the mass that is transverse to the bore for attaching the device to a shaft of a golf club.

9 Claims, 1 Drawing Sheet

GOLF CLUB WEIGHT TRAINING DEVICE

BACKGROUND OF THE INVENTION

The present invention relates to golf training devices, and, more particularly, to a weight that is removably attachable to any location on a golf club shaft.

Removable golf club weight training devices are known in the art. A number of these devices are attachable to a shaft of a golf club using various types of mechanisms. Many of these devices are of the type which attach to the golf club shaft only at the lower end of the shaft, i.e., adjacent the head of the golf club. Those devices which can be attached to different areas on the golf club shaft are commonly complicated and require some type of tightening mechanism to fixedly attach the weight to the shaft so that it does not move when the golf club is swung.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
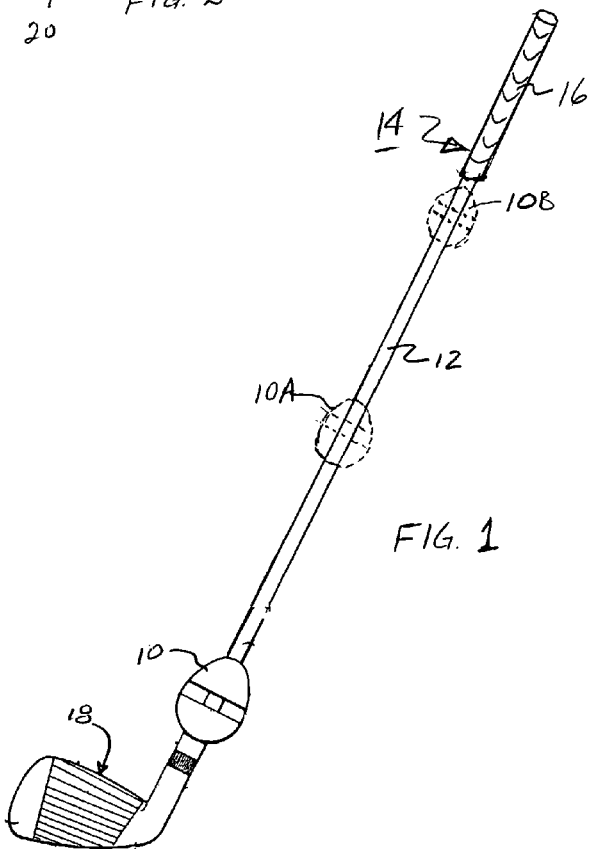
FIG. 1 illustrates the weight training device of the present invention positioned on a golf club shaft.

Turning now to FIG. 1, there is shown one embodiment of the inventive weight training device 10 positioned on a shaft 12 of the golf club 14. The golf club 14 is conventional having a handle 16 and a golf club head 18. The device 10 is typically football shaped, i.e., having a largest diameter in the center and then tapering to a smaller diameter at opposite ends. One of the features of the present invention is the ability to position the weight training device 10 at any location on the shaft 12 of the golf club. As illustrated in FIG. 1, the weight can be positioned midway on the shaft such as is indicated by the device 10A in phantom lines or the device could be positioned near the grip 16 of the club as shown by the phantom line representation at 10B. In order to understand how the device is constructed so as to be positionable at any of these selected locations on the shaft so that the device will not move when the shaft is swung, reference is now made to FIG. 2 which is a perspective view of the device 10. As will become apparent, the device 10 is generally football shaped as opposed to being oval, i.e., the device is uniform with respect to a center point so that either end may be placed in an up or down position. However, the particular shape of the device is not critical and the body may take the shape of a sphere, cube or rectangle. The device 10 has a longitudinal bore 20 extending from end to end of the device. The bore is preferably circular in cross-section and includes a plurality of circumscribing ribs 22 forming a sequence of discontinuous threads throughout the length of the bore. These circumferential or annular ribs 20 provide a plurality of surfaces which engage the surface of the golf club shaft 12 and inhibit sliding motion of the device 10 on the shaft 12. The bore 20 is sized to fit snugly on the shaft 12 regardless of the position of the device 10 on the shaft. Since the shaft 12 generally tapers from the grip 16 to the club head 18, the bore 20 is sized to fit snugly at the smallest diameter end of the shaft 12 adjacent the club head 18. At the upper end of the shaft 12 adjacent the grip 16, the device 10 fits more tightly about the club shaft whereby sliding motion of the device 10 is further inhibited.

Figure 3:
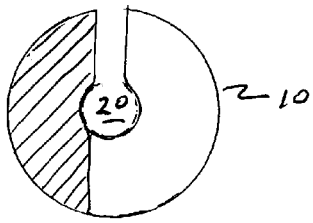
FIG. 3 is a cross-sectional view taken along the lines 3—3 of FIG. 2.
Figure 4:
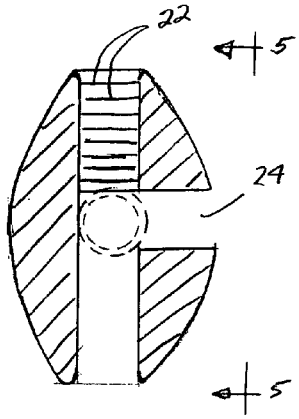
FIG. 4 is a cross-sectional view of the weight training device taken along the lines 4—4 of FIG. 2.
Figure 5:
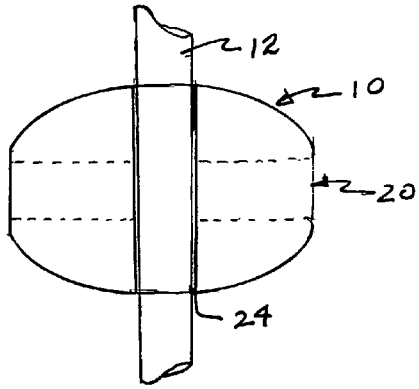
FIG. 5 is an elevation view showing the initial insertion of the club shaft into the access slot.

Considering FIGS. 2–5 concurrently, it can be seen that the device 10 has a slot-shaped opening or access slot 24 that extends into the device 10 and intersects the central bore 20. The slot 24 is transverse to the direction of the bore 20 and allows the device 10 to be attached to the club shaft 12 by pushing the device on to the shaft through the slot 24 and then rotating the device of about 90 degrees so that the shaft is directed into the central bore 20. The initial position of the shaft 12 in the slot 24 is shown in FIG. 5 prior to rotation of device 10 into the position shown in FIG. 1.

Figure 2:
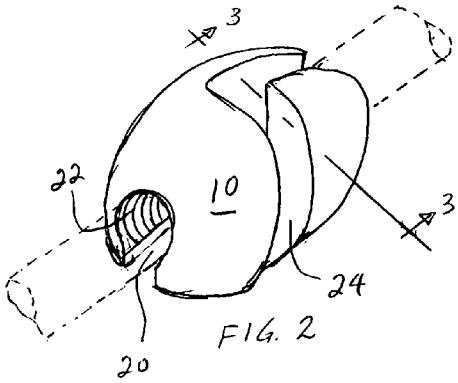
FIG. 2 is a perspective view of the weight training device of the present invention.

FIG. 3 is a cross-sectional view taken along the lines 3—3 of FIG. 2 and FIG. 4 is a cross-sectional view transverse to FIG. 3 through the central bore 20. FIG. 5 is an elevation view showing the initial insertion of the club shaft 12 into the access slot 24. The annular rings 22 in bore 20 are shown in FIG. 4.

The weight training device 10 is similar in shape and in the manner of installation to the device shown in U.S. Pat. No. 3,680,870. However, the device of the '870 patent is designed solely to be positioned on a golf club shaft adjacent the head of the club and has a large diameter bore at one end to enable the device to slide onto the hosel of the club head. The club head then acts as a retainer to prevent the device from disengaging from the club as the club is swung. The location of the weight device for training is limited to this one position and therefore only trains or loosens the large back muscles of the user.

In contrast, the present invention is constructed to fit at any location on a club shaft and to remain in that location while the club is swung. For example, the device 10 can be positioned as shown at 10B in FIG. 1 so that swinging of the club tends to cause a more pronounced wrist action to train the user in producing club head acceleration in the golf ball impact zone. By moving the weight device 10 to the position indicated at 10A, swinging the club effects strengthening of the forearms to produce a more forceful swing.

The weight device 10 uses a bore 20 diameter that fits snugly about shaft 12 at its smallest diameter, i.e., adjacent head 18, and therefore fits more tightly about shaft 12 at other locations. The annular ribs 22 provide a restraining function on shaft 12 while allowing the bore 20 to be sized to fit on shaft 12 without distorting the device 10 nor requiring excessive force to fit the device on shaft 12 where the shaft has its larger diameters. The device 10 is preferably a high-density polymer product such as polyurethane, having rubber-like characteristics. The weight of device 10 can be adjusted by molding metal weights, typically lead, into the device. However, applicant has found that younger golfers may use lighter weight devices of about 4 ounces and not require metal inserts. Different weights can be used for golfers of different strengths or skill levels but a weight of about 8 ounces has been found to be comfortable for most golfers. In such a typical embodiment, the device 10 is about 4 inches in length and about 2 inches in diameter at its widest point.

The invention claimed is:

1. A weight device for releasable attachment to any selected location on a shaft of a golf club, the device comprising:

a weight having a central bore sized for tightly engaging a shaft of a golf club;

a plurality of annular ribs circumscribing said central bore for preventing said weight from sliding on the shaft;

a slot-shaped opening extending across the weight transverse to and intersecting the central bore;

a first slice extending from one end of the slot-shaped opening to a first end of the weight and intersecting the central bore;

a second slice extending from another end of the slot-shaped opening to a second end of the weight and intersecting the central bore oppositely from the first slice, whereby the weight is placed on the golf club shaft by positioning the shaft in the slot-shaped opening and rotating the weight about ninety degrees such that the shaft passes through the first and second slices to enter the central bore.

2. The weight device of claim 1 wherein the central bore is tapered to conform to tapering of the golf club shaft.

3. The weight device of claim 2 wherein said weight device is generally football shaped.

4. The weight device of claim 3 wherein the device has a weight of about 8 ounces.

5. The weight device of claim 3 wherein the device is about 4 inches in length and 2 inches in diameter.

6. The weight device of claim 1 wherein the central bore is rounded to conform to a shape of the golf club shaft.

7. The weight device of claim 6 wherein the device is formed from an elastomeric material.

8. The weight device of claim 7 wherein each of the first and second slices creates corresponding deflectable segments of the device that are deflected during rotation of the device to allow the club shaft to enter the central bore of the device.

9. The weight device of claim 1 wherein the slot has a width of at least a largest diameter of a golf club shaft.

* * * * *